US005947598A

United States Patent [19]

Dedoes

[11] Patent Number: 5,947,598

[45] Date of Patent: Sep. 7, 1999

[54] AUTOMATIC PAINT STIRRING EQUIPMENT WITH IMPROVED DRIVING MEANS

[75] Inventor: John T. Dedoes, Brighton, Mich.

[73] Assignee: Dedoes Industries, Inc., Walled Lake, Mich.

[21] Appl. No.: 09/153,518

[22] Filed: Sep. 15, 1998

[51] Int. Cl.[6] ..... B01F 7/20

[52] U.S. Cl. ..... 366/198; 366/605

[58] Field of Search ..... 366/197, 198, 366/242–251, 331, 605

[56] References Cited

U.S. PATENT DOCUMENTS

| | | | |
|---|---|---|---|
| D. 356,585 | 3/1995 | Hersant et al. . | |
| 2,428,492 | 10/1947 | Haller . | |
| 2,521,384 | 9/1950 | Marienthal | 366/249 |
| 2,757,910 | 8/1956 | O'Neill | 366/605 |
| 2,802,649 | 8/1957 | Stockton | 366/197 |
| 2,965,363 | 12/1960 | Worden | 366/197 |
| 3,021,118 | 2/1962 | Dedoes | 366/247 |
| 3,041,052 | 6/1962 | Dedoes | 366/247 |
| 3,118,653 | 1/1964 | Dedoes | 366/251 |
| 3,175,808 | 3/1965 | Dedoes | 366/605 |
| 4,136,532 | 1/1979 | Okuda . | |
| 4,162,618 | 7/1979 | Okuda . | |
| 4,225,248 | 9/1980 | Para | 366/251 |
| 4,299,500 | 11/1981 | Bassetti | 366/198 |
| 4,407,584 | 10/1983 | Boudin et al. | 366/279 |
| 4,427,398 | 1/1984 | Eisbrecher et al. . | |
| 4,540,305 | 9/1985 | Geisthoff et al. . | |
| 4,692,127 | 9/1987 | Wagner . | |
| 5,020,700 | 6/1991 | Krzywdziak et al. . | |
| 5,080,634 | 1/1992 | Makase . | |
| 5,096,071 | 3/1992 | Neri | 366/605 |
| 5,098,343 | 3/1992 | Tysver et al. . | |
| 5,160,198 | 11/1992 | Fillon | 366/605 |
| 5,169,232 | 12/1992 | Fillon et al. | 366/605 |
| 5,195,840 | 3/1993 | Ruschke et al. . | |
| 5,263,899 | 11/1993 | Nozaki et al. . | |
| 5,310,258 | 5/1994 | Godat et al. | 366/251 |
| 5,358,153 | 10/1994 | Caldwell et al. . | |
| 5,360,376 | 11/1994 | Baldino . | |
| 5,368,388 | 11/1994 | Fillon | 366/245 |
| 5,368,389 | 11/1994 | Dedoes | 366/247 |
| 5,413,257 | 5/1995 | Amberger et al. . | |
| 5,437,385 | 8/1995 | Fillon . | |
| 5,454,639 | 10/1995 | Krzywdziak | 366/279 |
| 5,456,534 | 10/1995 | Krzywdziak | 366/605 |

(List continued on next page.)

FOREIGN PATENT DOCUMENTS

| | | | |
|---|---|---|---|
| 0 035 422 A1 | 9/1981 | European Pat. Off. . | |
| 127589 | 12/1984 | European Pat. Off. | 366/605 |
| 0298806 A1 | 1/1989 | European Pat. Off. . | |
| 2102417 | 4/1972 | France | 366/198 |
| 2521493 | 8/1983 | France | 366/605 |
| 2562874 | 10/1985 | France . | |
| 2742072 | 1/1998 | France . | |
| 858607 | 12/1952 | Germany | 366/197 |
| 2203059 | 10/1988 | United Kingdom | 366/605 |

*Primary Examiner*—Charles E. Cooley
*Attorney, Agent, or Firm*—Gifford, Krass, Groh, Sprinkle, Anderson & Citkowski, P.C.

[57] ABSTRACT

Automatic paint stirring equipment having a rack with a plurality of vertically spaced drive units wherein each drive unit has an interior. A closed loop belt is rotatably mounted within the interior of each drive unit and this belt has longitudinally spaced teeth on one side of it. A motor rotatably drives the drive belts in the drive units in unison with each other. The shelves support one or more paint cans in a side by side relationship with each can having a cover disposed across its open top. A stirring element is disposed within the interior of the paint can while a shaft is connected to the stirring element and rotatably mounted to the cover so that a portion of the shaft protrudes upwardly from the cover. A gear wheel is coaxially secured to the upwardly protruding portion of the shaft. A guide assembly is secured to the rack and engages the drive shaft to guide the drive shaft between an engaged position, in which the gear wheel on the drive shaft meshingly engages the drive belt from the drive unit, and a disengaged position in which the paint can with its attached cover is removed from the rack for use.

11 Claims, 4 Drawing Sheets

U.S. PATENT DOCUMENTS

| | | | |
|---|---|---|---|
| 5,482,370 | 1/1996 | Dedoes | 366/605 |
| 5,496,109 | 3/1996 | Dedoes | 366/605 |
| 5,498,076 | 3/1996 | Krzywdziak | 366/245 |
| 5,498,077 | 3/1996 | Krzywdzjak et al. | 366/605 |
| 5,503,474 | 4/1996 | Krzywdziak | 366/347 |
| 5,511,878 | 4/1996 | Dedoes et al. | 366/605 |
| 5,542,761 | 8/1996 | Dedoes | 366/605 |
| 5,586,822 | 12/1996 | Krzywdziak | 366/247 |
| 5,603,426 | 2/1997 | Krzywdziak et al. . | |
| 5,622,289 | 4/1997 | Dedoes . | |
| 5,697,703 | 12/1997 | Lucchetti | 366/605 |
| 5,800,057 | 9/1998 | Lesimple | 366/249 |

12
64
74
78
50
76
40
52
3
3
32
88
66
70
36
34
88
16
12
84
30
80
86
88
MOTOR
90

AUTOMATIC PAINT STIRRING EQUIPMENT WITH IMPROVED DRIVING MEANS

BACKGROUND OF THE INVENTION

I. Field of the Invention

The present invention relates generally to automatic paint stirring equipment and, more particularly, to an improved drive assembly for such equipment.

II. Description of the Prior Art

The automatic paint stirring equipment of the type commonly found in automotive paint shops typically comprises a rack having vertically spaced shelves adapted to receive and removably support a plurality of paint cans in a side by side relationship with each paint can positioned at a station on the rack shelf. Each paint can, furthermore, includes a cover which extends across the open top of the paint can. A stirring element is positioned within the interior of the paint can while a shaft is secured to the stirring element and is rotatably mounted to the paint can cover such that a portion of the shaft protrudes upwardly from the paint can cover.

In order to rotatably drive the shaft, and thus the stirring elements, the previously known automatic paint stirring equipment typically included a plurality of pulleys mounted to each shelf of the rack such that one pulley was associated with each paint can station. A closed loop belt was disposed around the pulleys and rotatably driven by the motor so that the pulleys rotate in unison with each other.

In order to connect the pulleys with the shafts on the paint can cover, the previously known automatic paint stirring equipment included an axle secured to each pulley which depended downwardly towards the paint can supported on the shelf immediately below. A drive member, typically in the form of a generally planar rectangular member, was connected to the axle while a driven member was secured to the upwardly extending portion of the stirring element shaft. This driven member, furthermore, typically included two spaced apart and upwardly extending pins dimensioned so that, upon insertion of the paint can into one station and coaxially beneath one pulley of the drive unit on the next upper shelf, the drive member and driven member drivingly couple together.

One disadvantage of the previously known automatic paint stirring equipment, however, is that multiple components are necessary at each station in order to accommodate each paint can on the rack. These multiple components include not only the pulley and its associated drive shaft and drive member, but also the bushings and associated components necessary to mount the pulleys to the drive unit. These multiple components not only increased the overall cost of the automatic paint stirring equipment, but also are subjected to mechanical wear thus requiring periodic maintenance.

SUMMARY OF THE INVENTION

The present invention provides automatic paint stirring equipment which overcomes all of the above-mentioned disadvantages of the previously known devices.

In brief, the automatic paint stirring equipment of the present invention comprises a rack having a plurality of vertically spaced drive units wherein each drive unit includes an interior chamber. The drive units are secured together so that they are vertically spaced apart from each other by a distance sufficient so that the paint cans can be inserted and supported by the drive units in a side by side relationship between adjacent shelves at predefined longitudinally spaced stations along each shelf.

Each paint can utilized with the rack, furthermore, includes a paint can cover disposed across and secured to the open top of the paint can. A stirring element or paddle is contained within the interior of the paint can while a shaft is secured to the stirring element and rotatably mounted to the cover such that a portion of the shaft protrudes upwardly from the paint can cover. A gear wheel is then coaxially secured to the upwardly protruding portion of the stirring element shaft.

A closed loop belt is rotatably mounted within the interior of each drive unit. This belt, furthermore, has a plurality of longitudinally spaced teeth along one side. A drive gear is also rotatably mounted to each drive unit such that the drive gear is in mesh with the drive belt. A segmented shaft drivingly connects the drive gears in the spaced drive units to a motor contained within the rack so that, upon activation of the motor, the drive gears rotatably drive the toothed belts in unison with each other.

A plurality of guide assemblies are secured to each drive unit in a side by side relationship such that one guide assembly is provided at each paint can station along the drive unit. Each guide assembly includes an elongated slot open at a front end of the rack and adapted to slidingly receive the stirring element shaft. The slot, furthermore, is dimensioned to guide the shaft, and thus the paint can, between an engaged position in which the gear wheel on each stirring element shaft meshes with the drive belt contained in the drive unit, and a disengaged or removed position in which the paint can cover with its attached can is removed from the rack for use. Consequently, with the paint can in the engaged position, the meshing engagement between the gear wheel on the stirring element shaft and the drive belt drivingly connects the gear wheel and belt together thus rotatably driving the stirring element in the desired fashion.

Consequently, by using the meshing engagement between the drive belt and the gear wheel mounted to each paint can cover, the previously known necessity of the pulleys, drive shafts and drive members associated with each paint can on the rack are completely eliminated thereby reducing costs and maintenance.

Further improvements of the present invention include the use of a segmented shaft for drivingly connecting the toothed belts to a motor contained within the rack which facilitates assembly of the paint stirring equipment by the end user. Similarly, in the preferred embodiment of the invention, the gear wheel associated with each paint can cover includes frangible links which break when the torsion between the drive belt and the gear wheel exceeds a predetermined amount. These frangible links thus break in the event of a jam of the stirring element (which can occur, for example, in the case of a dented paint can) thus protecting the relatively expensive drive belt from damage.

Still further enhancements and improvements of the present invention over the prior art automatic paint stirring equipment will become apparent upon reference to the following detailed description of the invention.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
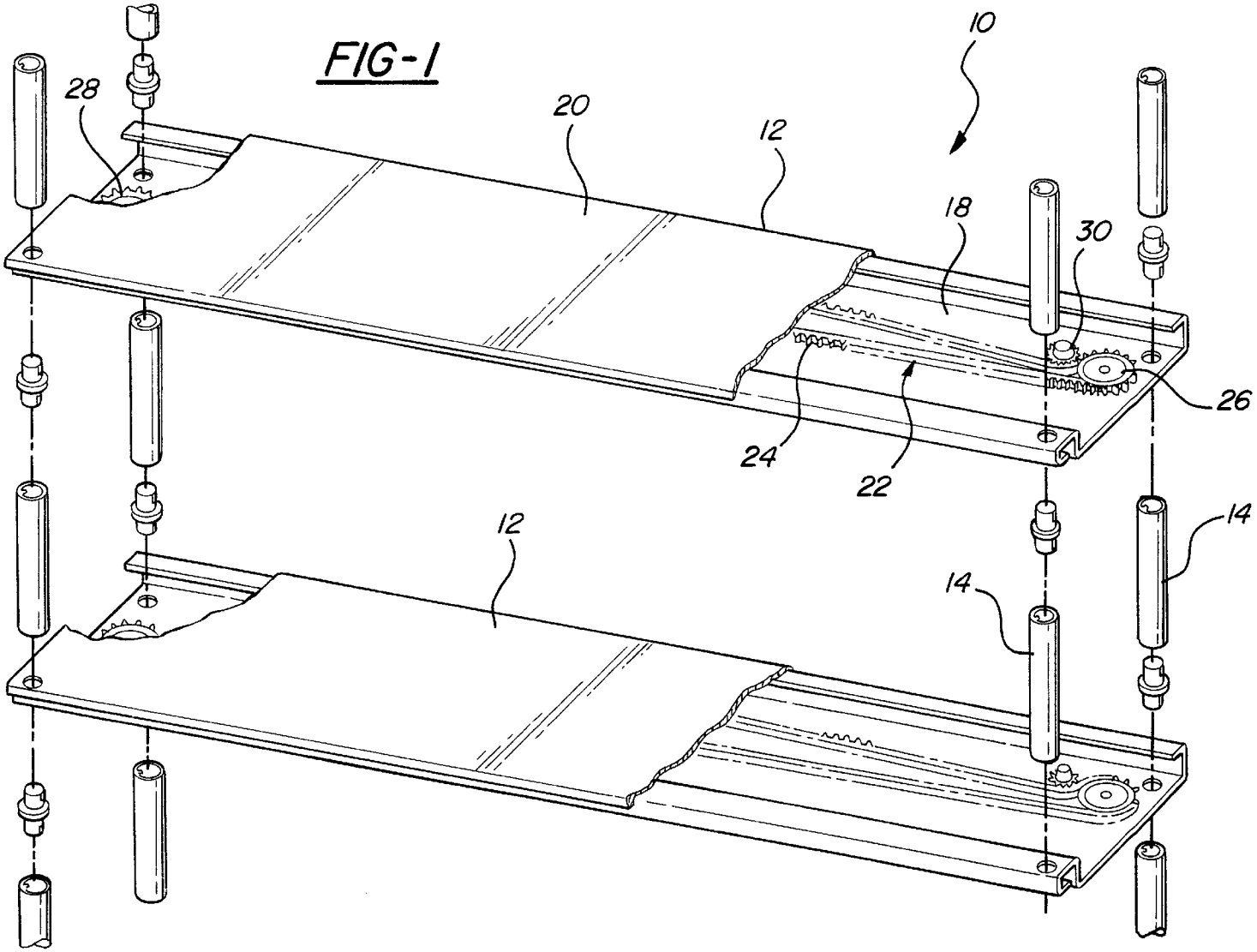
FIG. 1 is an elevational view showing a portion of the preferred embodiment of the invention.

With reference first to FIG. 1, a preferred embodiment of the automatic paint stirring equipment 10 of the present invention is there shown and comprises a plurality of elongated drive units 12, each of which are substantially identical to each other. Any conventional means, such as support columns 14, are used to secure the drive units 12 together in a vertically spaced apart and parallel relationship. Furthermore, the spacing between each pair of adjacent drive units 12 is sufficient to accommodate a plurality of paint cans 16 (FIG. 2) in a side by side relationship at longitudinally spaced stations along the drive units.

Still referring to FIG. 1, each drive unit includes an interior chamber 18 having a top cover 20 which covers and encloses the interior chamber 18. A closed loop elongated belt 22 having longitudinally spaced gear teeth 24 on one side is rotatably mounted between two idler pulleys 26 and 28 disposed on opposite ends of the drive unit 12. Furthermore, a drive gear 30, which will subsequently be described in greater detail, is rotatably mounted within the interior 18 of each drive unit 12 such that the drive unit 30 meshingly engages with the drive belt 22. Consequently, upon rotation of the drive gear 30, the drive gear 30 rotatably drives its associated drive belt 22 in its drive unit 12.

Figure 2:
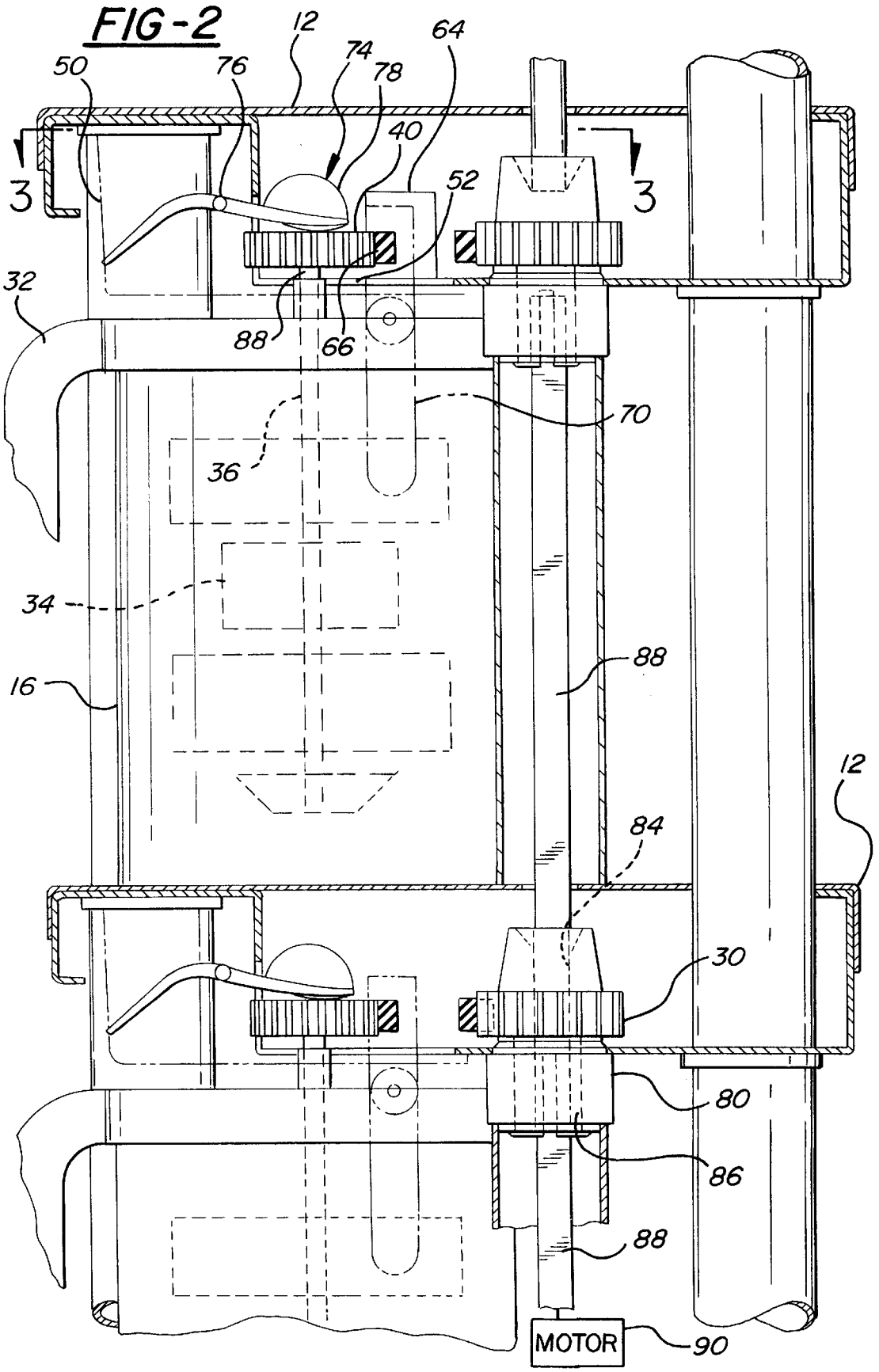
FIG. 2 is a fragmentary side sectional view illustrating a portion of the preferred embodiment of the present invention.

With reference now to FIG. 2, the paint can 16 includes a cover 32 extending across and covering its open top. A stirring element or paddle 34 is contained within the interior of the paint can 16 while a shaft 36 is secured to the stirring element 34 and rotatably mounted to the paint can cover 32 such that a portion 38 of the shaft protrudes upwardly from the paint can cover 32. A gear wheel 40 is then coaxially secured to the upwardly protruding portion 38 of the shaft 36.

Figure 4:
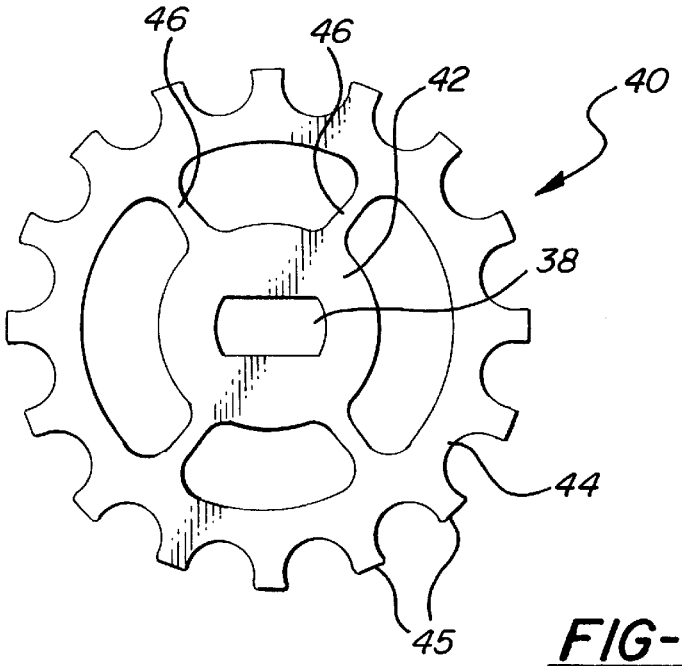
FIG. 4 is a top view of the paint can gear wheel.

With reference now to FIG. 4, the gear wheel 40 is there shown in greater detail. The gear wheel 40 includes an inner hub 42 secured to the upwardly protruding portion 38 of the stirring element shaft 36 as well as an outer annulus 44. Outwardly extending teeth 45 are formed around the outer periphery of the annulus 44. A plurality of circumferentially spaced frangible links 46 drivingly secure the hub 42 to the annulus 44.

Preferably, the entire gear wheel 40 is of a one piece plastic construction. Consequently, whenever the torque between the hub 42 and the outer annulus 44 exceeds a predetermined amount as determined by the construction of the frangible links 46, the frangible links 46 break thus disengaging the annulus 44 from the hub 42. As will become shortly apparent, such an excessive torque could result from a jam of the stirring element 34 (FIG. 2) in the paint can 16.

Figure 3:
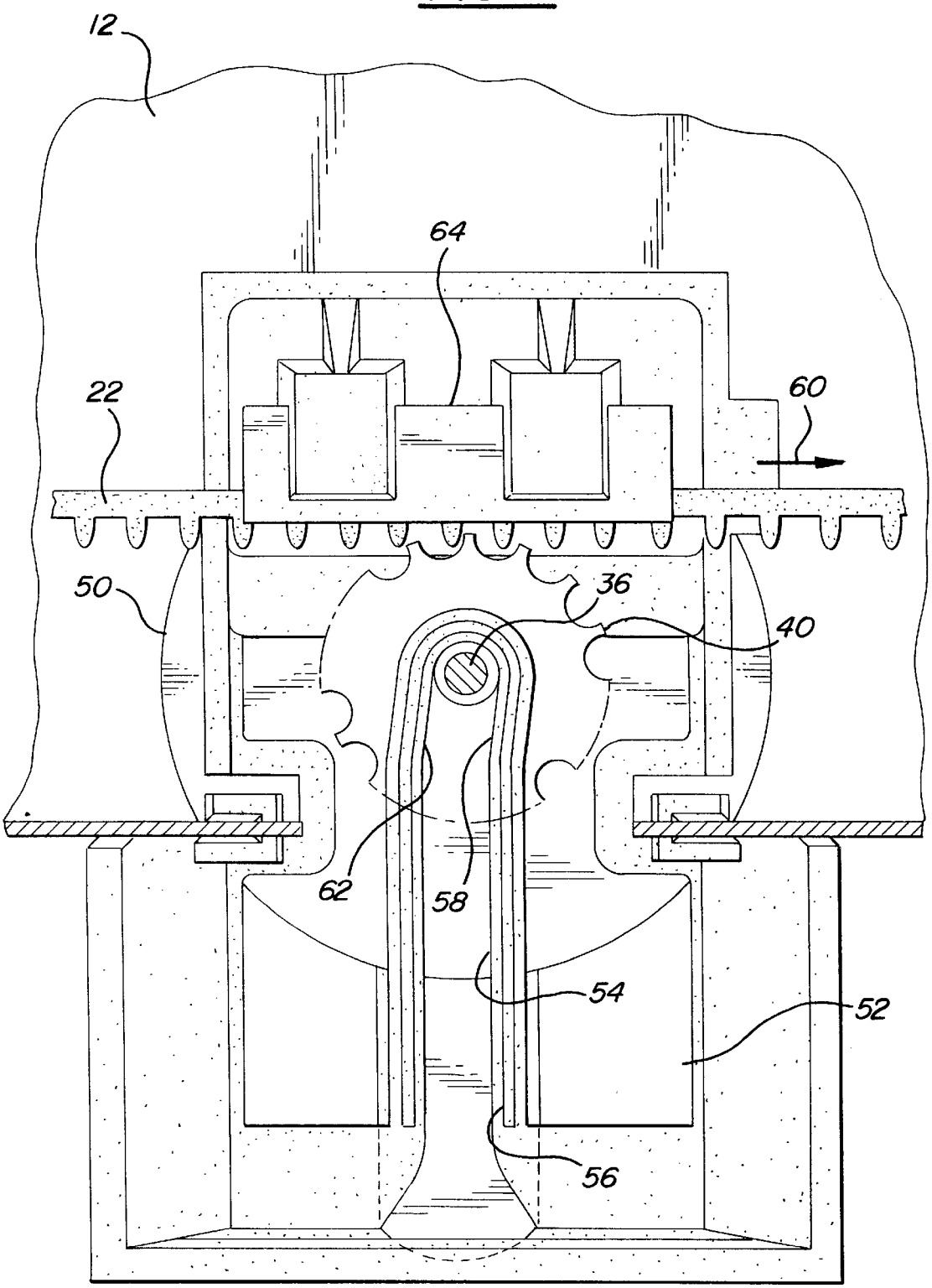
FIG. 3 is a view taken substantially along line 3—3 in FIG. 2.

With reference now to FIGS. 2 and 3, a plurality of guide assemblies 50 (only one illustrated) are secured to each drive unit 12 with one guide assembly at each paint can station. Each guide assembly 50 includes a guide plate 52 having an elongated slot 54 (FIG. 2) open at a front end 56 of its associated drive unit 12. The slot 54, furthermore, is dimensioned to slidably receive and guide the upwardly protruding portion 38 of the stirring clement shaft 36 between an engaged position, illustrated in FIGS. 2 and 3, and a disengaged or removed position in which the paint can 16 is removed from its associated drive unit 12.

In its engaged position, the gear wheel 40 on the paint can cover 32 meshes with the tooth belt 22 so that longitudinal movement of belt 22 as viewed at arrow 55 in FIG. 3 rotatably drives the gear wheel 40 with its attached stirring element 34. Furthermore, the meshing engagement between the drive belt 22 and the gear wheel 40 occurs automatically upon insertion of the paint can 16 to the engaged position illustrated in FIG. 3.

As best shown in FIG. 3, the guide slot 54 is preferably angled slightly at its inner end 58 in the direction of travel, i.e. arrow 55, of the belt 22. This angled portion of the drive slot facilitates in seating the portion 38 of the paint cover shaft 36 at the innermost end of the slot 54.

In the preferred embodiment of the invention, the guide slot 54 preferably includes a restriction 62 adjacent its inner end 58. The restriction 62 narrows with the slot 54 to a distance slightly less than the diameter of the stirring element shaft portion 38. Thus, upon insertion of the paint can cover to its engaged position illustrated in FIG. 3, the guide plate 52, which is constructed of a semi-flexible material such as plastic, flexes slightly outwardly as the shaft portion 38 passes across the restriction 62 to allow the paint can to reach its engaged position illustrated in FIG. 3. Upon doing so, the guide plate 52 returns to its unflexed state such that the restriction 62 frictionally, but releasably, retains the shaft portion 36, and thus the paint can 16, in its engaged position.

With reference still to FIG. 3, the guide assembly 50 further includes a guide block 64 aligned with the slot 54. The guide block 64 includes a channel 66 (FIG. 2) along which the belt 22 slides in order to maintain the meshing engagement between the belt 22 and gear wheel 40 once the paint can 16 is inserted to its engaged position.

As shown in FIG. 2, an anti-rotation lever 70 is pivotally mounted by a pin 71 to the guide assembly 50 adjacent one side of the guide assembly 50. The lever 70 abuts against the paint can cover 32 and, more particularly, against the spout of the paint can cover 32, to prevent rotation of the paint can 16 once the paint can is inserted to its engaged position. The pivotal connection of the anti-rotation lever 70 allows the guide assembly 50 to accommodate different size paint cans 16.

With reference to FIG. 2, a guard assembly 74 is mounted by a pivot pin 76 to the guide assembly 50. Upon removal of the paint can 16 from the guide slot 54, a weighted portion 78 of the guard assembly 74 pivots against the guide plate 52 so that the weighted portion 78 obscures the drive belt 22 from a front side of the drive unit 12. The guard assembly 74 thus protects against the insertion of foreign objects, fingers and the like, against the drive belt 22 when the paint can 16 is removed from the drive unit 12.

Still referring to FIG. 2, the drive gear 30 is there shown in greater detail and includes a bushing 80 which is secured to the drive unit 12 in any conventional fashion, such as by screws. The drive gear 30 then snaps into the bushing 80 thus rotatably mounting the drive gear 30 to the drive unit 12.

Each drive gear 30 includes a non-circular, preferably square, bore 82 formed through it. In order to drivingly connect the drive gears 30 together, a plurality of drive shaft segments 88 having a cross-sectional shape complementary to the drive gear bore 82, preferably square, are positioned through the drive gear 30 so that the bottom of one drive shaft segment 88 abuts against the top of the next lower drive shaft segment 88. One drive shaft segment 88 is, in turn, drivingly connected to a motor 91.

The drive shaft segments 88, due to their complementary shape to the non-circular drive gear bores 82, drivingly connect the gears 30 together. This construction of the drive shaft segments 88 together with the drive gears 30 not only is inexpensive, but facilitates the assembly of the overall paint stirring equipment since the drive units 12 are sequentially secured together. Thus, once two drive units 12 have been secured together, a drive shaft segment 88 is merely inserted through the registering bores 82 of the two assembled drive units 12 and that process is repeated until the assembly of the automatic paint stirring equipment is completed. The construction of the segmented drive shaft segments 88 also eliminate binding which could otherwise occur if a one piece drive shaft were utilized.

Figure 5:
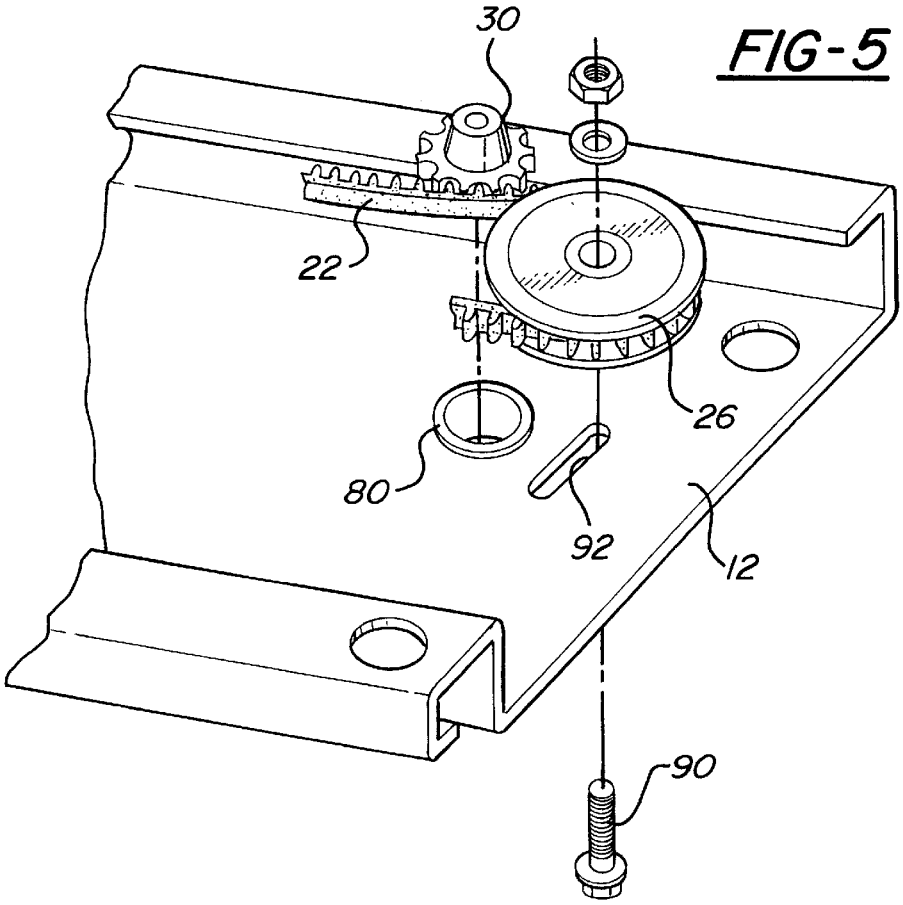
FIG. 5 is a fragmentary view illustrating a portion of the drive mechanism of the preferred embodiment of the invention.

With reference now to FIG. 5, the assembly of the drive gear 30, as well as one idler gear 26, is there shown in greater detail. One idler gear 26 at one end of the drive unit 12 is secured to the drive unit 12 by a threaded fastener 90. The fastener 90 extends through a slot 92 in the drive unit 12 which slot 92 extends in a direction transverse to the direction of travel of the drive belt 22. This connection between the idler wheel 26 and the drive unit 12 thus permits the position of the idler wheel 26 to be adjusted along the slot 92 in order to adjust the tension of the drive belt 22.

Still referring to FIG. 5, the provision of two idler wheels 26 at opposite ends of the drive unit 12 as well as the single drive gear 30 also enables the drive belt 22 to be removed from the drive unit 12, for example for replacement purposes, by simply loosening the idler wheel 26, eliminating the tension on the drive belt 22 and removing the drive belt 22.

In operation, the paint can 16 is selectively inserted to its engaged position (FIG. 2) thus engaging the gear wheel 40 with the drive belt 22. The motor 91 drives the drive gears 30 in unison with each other thus rotatably driving the drive belts 22 and rotating the stirring elements 34 in the paint cans 16 which are positioned in their engaged position relative to the drive units 12.

In the event that a stirring element 34 becomes jammed relative to its associated can, which could occur by a dent in the can, torque is applied to the gear wheel secured to the stirring element shaft 36. Once the torque between the drive belt 22 and shaft 36 exceeds a predetermined amount, the frangible links 46 snap thus breaking the gear wheel 40. This protects the drive belt 22 from damage which is much more expensive to replace than a single gear wheel 40.

From the foregoing, it can be seen that the present invention provides automatic paint stirring equipment which is low cost in construction and yet efficient in operation. This low cost construction is achieved primarily by replacing the multiple pulleys, bushings, etc. of the previously known automatic paint stirring equipment with the single drive belt 22 and its associated idler pulleys 26 and 28 and drive gear 30.

Having described my invention, however, many modifications thereto will become apparent to those skilled in the art to which it pertains without deviation from the spirit of the invention as defined by the scope of the appended claims.

I claim:

1. Automatic paint stirring equipment comprising:

at least one paint can having a cover disposed across a top of the paint can, a stirring element disposed within the paint can, a shaft connected to the stirring element and rotatably mounted to said cover, said shaft having a portion protruding upwardly from said cover, and a gear wheel coaxially secured to said upwardly protruding portion of said shaft, a rack having a plurality of vertically spaced drive units, each drive unit having interior, a closed loop drive belt rotatably mounted in the interior of each drive unit, said belt having longitudinally spaced teeth on one side, means for supporting said paint can on said rack in a side by side relationship so that said gear wheel is positioned in said interior of said rack and in mesh with said drive belt, means for rotatably driving said drive belt.

2. The invention as defined in claim 1 wherein said rotatable driving means comprises a drive gear, means for rotatably mounting said drive gear to its associated drive unit so that said drive gears in adjacent drive units are coaxial with each other, shaft means for drivingly connecting said drive gears together, and a motor drivingly connected to said shaft means.

3. The invention as defined in claim 2 wherein each drive gear includes a non-circular coaxial throughbore, and wherein said shaft means comprises a segmented shaft having a cross-sectional shape substantially the same as said non-circular throughbore, one segment of said segmented shaft extending between each pair of adjacent drive gears.

4. The invention as defined in claim 3 wherein said non-circular coaxial throughbore is square in shape.

5. The invention as defined in claim 2 and comprising an idler pulley associated with each drive unit, means for rotatably mounting said idler pulley to its associated drive unit adjacent said drive gear so that said idler pulley supports said drive belt on the side opposite from the toothed side of the drive belt, wherein said means for rotatably mounting said idler pulley to its associated drive unit comprises a slot in said drive unit extending in a direction transverse to the direction of travel of said drive belt and fastener means for securing said idler pulley to said drive unit at an adjusted position along said slot, whereby adjustment of said idler pulley relative to said slot adjusts the tension of said drive belt.

6. The invention as defined in claim 5 and comprising a second idler pulley rotatably mounted to each drive unit at an end of the drive unit opposite from the drive gear, said second idler pulley supporting said drive belt on the side opposite from the toothed side of the drive belt.

7. The invention as defined in claim 1 and further comprising a guide assembly for guiding the movement of the paint can between an engaged position in which said gear wheel meshingly engages said drive belt, and a removed position in which the gear wheel is disengaged from said drive belt, said guide assembly comprising a plate having an elongated slot adapted to slidably receive said shaft, said shaft being positioned at one end of said slot when said paint can is in said engaged position.

8. The invention as defined in claim 7 wherein said plate slot includes a restriction adjacent said one end of said slot, said restriction having a width less than the diameter of said shaft.

9. The invention as defined in claim 7 wherein said one end of said slot is laterally offset from a longitudinal axis of said slot.

10. The invention as defined in claim 7 wherein said guide assembly comprises a guard pivotally mounted between a protected position when said paint can is in said removed position in which a portion of said guard obscures access to said drive belt through said guide assembly, and an accessible position upon insertion of said paint can through said guide assembly to said engaged position.

11. The invention as defined in claim 1 wherein said gear wheel includes at least one frangible link for securing an outer toothed portion of the gear wheel to said shaft.

* * * * *